United States Patent [19]

Ward

[11] Patent Number: 4,843,726

[45] Date of Patent: Jul. 4, 1989

[54] STUD ALIGNMENT AND POSITIONING TOOL

[76] Inventor: James E. Ward, R.D. 3, Box 249 (Iona Rd.), Franklinville, N.J. 08322

[21] Appl. No.: 145,268

[22] Filed: Jan. 19, 1988

[51] Int. Cl.[4] ..... B23P 19/00

[52] U.S. Cl. ..... 33/613; 33/645; 33/562; 52/127.2; 269/43; 269/104; 269/904

[58] Field of Search ..... 33/613, 562, 645; 269/104, 43, 904, 910, 37, 45, 44, 36, 40; 52/127.2

[56] References Cited

U.S. PATENT DOCUMENTS

| | | | |
|---|---|---|---|
| 1,787,799 | 1/1931 | Soule et al. | 269/36 X |
| 2,483,957 | 10/1949 | Wright | 269/104 X |
| 2,686,959 | 8/1954 | Robinson | 33/613 |
| 2,991,857 | 7/1961 | Soderberg | 33/613 X |
| 3,631,578 | 1/1972 | Shangler | 269/43 X |

*Primary Examiner*—William D. Martin, Jr.
*Attorney, Agent, or Firm*—Leon Gilden

[57] ABSTRACT

A stud alignment and positioning tool is set forth wherein a plurality of rigid jaws are securable to a series of wall studs by use of temporary securement means such as nails and the like. The rigid jaws are integrally secured to rigid interconnection members formed of angularly oriented planar portions. The integral connection of the rigid jaws to the interconnection members are at acute angles to one another to enable the instant invention to triangulate between framing portions of a studded wall developing rigidity and strength in the alignment and temporary securement of the studs.

4 Claims, 3 Drawing Sheets

STUD ALIGNMENT AND POSITIONING TOOL

BACKGROUND OF THE INVENTION

1. Field of the Invention

The field of invention relates to alignment tools and more particularly pertains to a new and improved stud alignment and positioning tool wherein the tool is temporarily securable at a corner of a studded wall to triangulate the tool with the vertical and horizontal framing studs.

2. Description of the Prior Art

The use of stud alignment tools and the like is well known in the prior art. As may be appreciated, these devices have relied upon their internal structure for rigidity and strength in securement and positioning of a plurality of studs. In this connection, there have been several attempts to develop stud alignment and positioning tools which may be readily and efficiently secured to a studded wall for providing temporary strength and alignment to the wall during the positioning and fastening of studs therealong. For example, U.S. Pat. No. 2,567,586 to Werder sets forth a linearly oriented templet for setting studs or timbers wherein nailing is permitted parallel to the rigid jaws of Werder only and furthermore provides no means for enabling a triangulation of a series of studs proximate a corner of a studded wall for an enhanced strength and rigidity in use. The Werder patent is a functional solution for providing a templet for studs and the like but fails to provide a means for enhancing the rigidity and strength of a studded wall by the positioning of the templet relative to higher strength portions of the wall, such as the framed corners.

U.S. Pat. No. 2,686,959 to Robinson sets forth a spacing device wherein a series of jaws secure a like series of objects, as described, with respect to one another. The plurality of clamping elements are of linear alignment and fail to provide any means for utilizing temporary fasteners, such as nails and the like, in the positioning of studs along a wall.

U.S. Pat. No. 3,201,874 to Christy sets forth another linear stud positioning gage wherein a plurality of jaws include a spring biased portion for providing the grasping of the studs within the jaws. The Christy device, as other devices of the prior art, fails to provide the necessary strength by virtue of orientation of the device with respect to the wall and further fails to enable the use of temporary fasteners, such as nails, in securement of the device to a studded wall.

U.S. Pat. No. 3,768,798 sets forth a manually adjustable toothing device utilized particularly with masonry work. The device includes a plurality of spacing plates arranged to variably accommodate, in an adjustable manner, spacing movements towards and away from each other by means of pivotal interconnections and by manually adjusting biasing means. Retaining of the spacing plates is available for selected spacing positions relative to one another in the formation of a mortared wall. The Dankert patent is of interest relative to a spacing tool but is relatively remote from the instant invention.

U.S. Pat. No. 4,079,497 to Jernigan provides a fixtures including a plurality of toothed spacing members for making substantially impenetrable portions, such as a wall or floor member for bank vaults and the like. As in the Dankert patent, the Jernigan patent is of interest relative to a spacing device but is again relatively remote from the instant invention.

U.S. Pat. No. 4,322,064 to Jarvis sets forth a plurality of serially disposed and pivotally interconnected elements to form jaws and present a spacing tool, as typically in the formation of roof trusses and the like, but as in other prior art devices, is of linear construction and use and relies essentially on the tools own rigidity for the securement and alignment of the associated studs of a truss, for example.

As such, it may be appreciated that there is a continuing need for a new and improved stud alignment and positioning tool which addresses both the problem of rigidity, strength and alignment of associated studs of a wall and in this respect, the present invention substantially fulfills this need.

SUMMARY OF THE INVENTION

In view of the foregoing disadvantages inherent in the known types of stud alignment and positioning tools now present in the prior art, the present invention provides a stud alignment and positioning tool wherein the same may be effectively and easily secured to a series of studs for triangulation with associated framing studs for enhanced strength and rigidity in the alignment and securement of the associated studs. As such, the general purpose of the present invention, which will be described subsequently in greater detail, is to provide a new and improved stud alignment and positioning tool which has all the advantages of the prior art stud alignment tools and none of the disadvantages.

To attain this, the present invention comprises a plurality of rigid jaws formed with openings for securement of the jaws to the studs along the studs width and depth. Triangulated interconnection members are integrally secured at angular orientations to the walls of the rigid jaws for the forming of an elongate member positionable proximate the terminal framing portions of a wall to provide enhanced rigidity and strength to associated secured studs of the instant invention during use of the instant invention.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved stud alignment and positioning tool which has all the advantages of the prior art stud alignment and positioning tools and none of the disadvantages.

It is another object of the present invention to provide a new and improved stud alignment and positioning tool which may be easily and efficiently manufactured and marketed.

It is a further object of the present invention to provide a new and improved stud alignment and positioning tool which is of a durable and reliable construction.

An even further object of the present invention is to provide a new and improved stud alignment and positioning tool which is susceptible of a low cost of manufacture with regard to both materials and labor, and which accordingly is then susceptible of low prices of sale to the consuming public, thereby making such stud alignment and positioning tools economically available to the buying public.

Still yet another object of the present invention is to provide a new and improved stud alignment and position tool which provides in the apparatuses and methods of the prior art some of the advantages thereof, while simultaneously overcoming some of the disadvantages normally associated therewith.

Still another object of the present invention is to provide a new and improved stud alignment and positioning tool wherein a plurality of gapped rigid jaws are securable to a series of studs.

Yet another object of the present invention is to provide a new and improved stud alignment and positioning tool wherein a plurality of rigid jaws are interconnected by a series of triangulated interconnection members forming an elongate rigid tool securable proximate a corner of a studded wall triangulating associated secured studs by the positioning tool.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
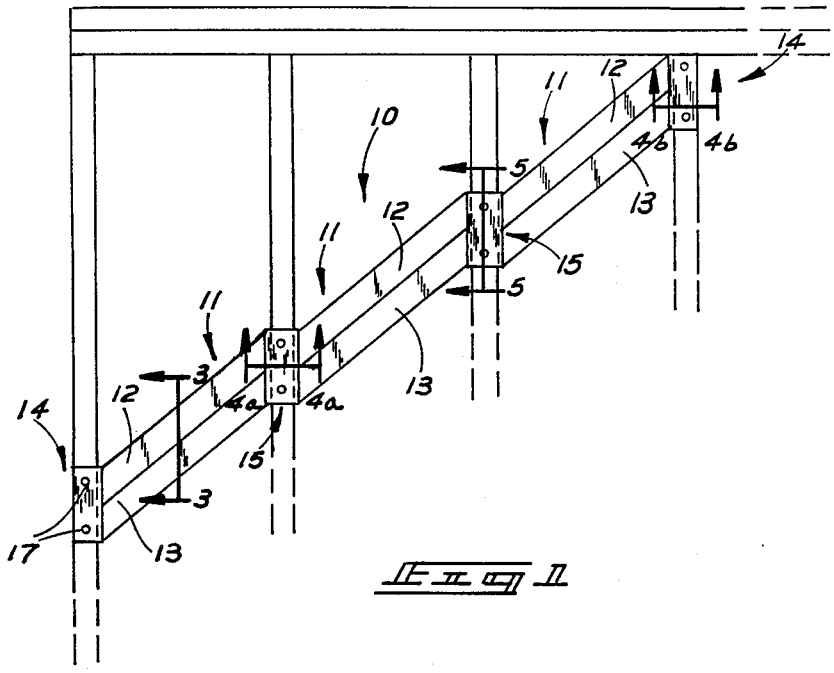
FIG. 1 is an orthographic elevation view of the instant invention associated in situ with a studded wall.

With reference now to the drawings, and in particular to FIGS. 1 to 6 thereof, a new and improved stud alignment and positioning tool embodying the principles and concepts of the present invention and generally designated by the reference numeral 10 will be described.

The stud alignment positioning tool 10 of the instant invention essentially comprises a plurality of interconnection members 11 integrally secured to a plurality of terminal end jaw members 14 and a plurality of intermediate jaw members 15. The interconnection members 11 are formed essentially as illustrated in the drawings and with particular attention to FIGS. 3 and 5, there is illustrated the triangulated association of a first connector 12 and second connector 13 joined integrally at an apex for rigidity in the structural association of the various jaw members.

Figure 2:
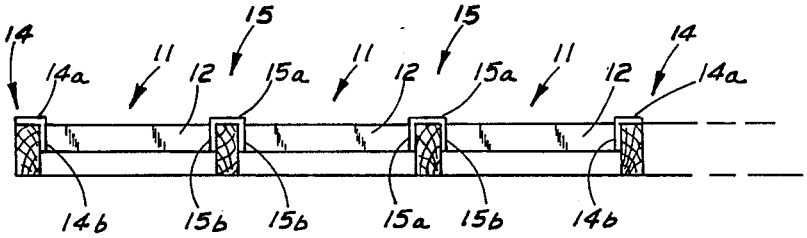
FIG. 2 is a top orthographic view of the instant invention associated with a studded wall.
Figure 3:
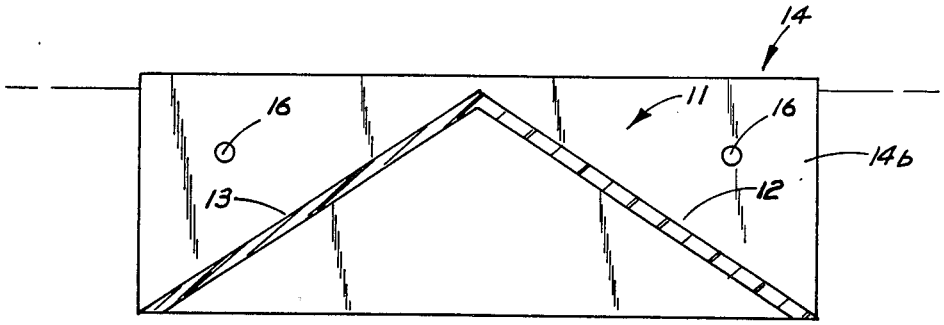
FIG. 3 is an orthographic view taken along the lines 3—3 of FIG. 1 in the direction indicated by the arrows.
Figures 4A, 4B:
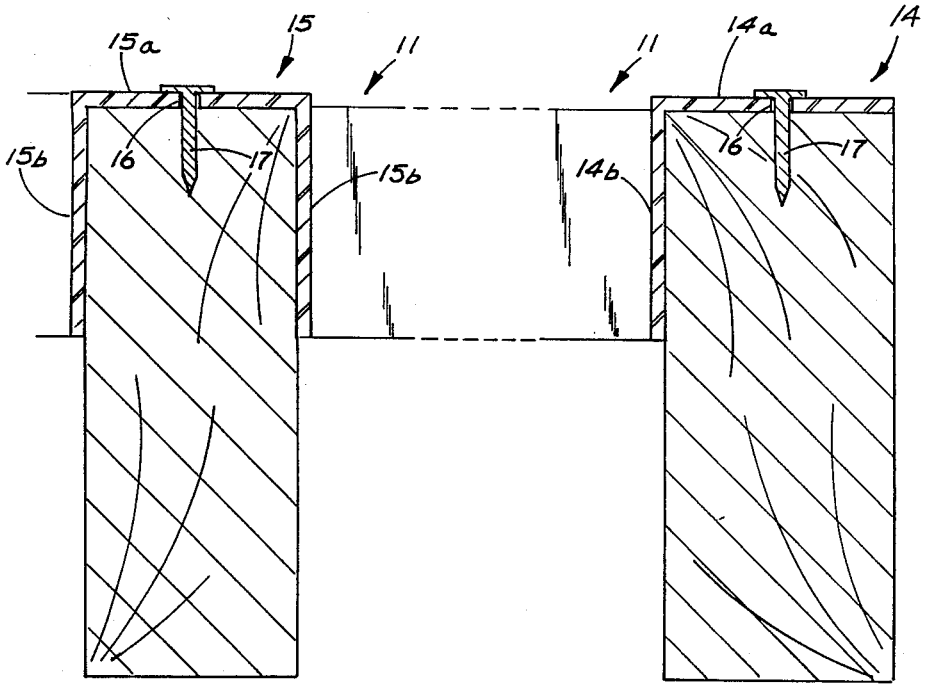
FIG. 4*a* is an orthographic view taken along the lines 4*a*—4*a* of FIG. 1 in the direction indicated by the arrows.
FIG. 4b is an orthographic view taken along the lines 4*b*—4*b* of FIG. 1 in the direction indicated by the arrows.
Figure 5:
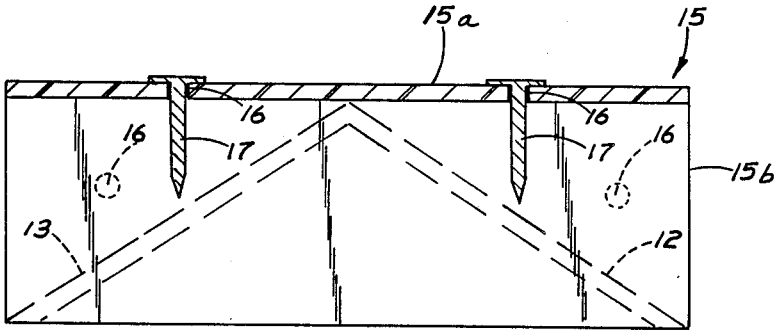
FIG. 5 is an orthographic view taken along the lines 5—5 of FIG. 1 in the direction indicated by the arrows.
Figure 6:
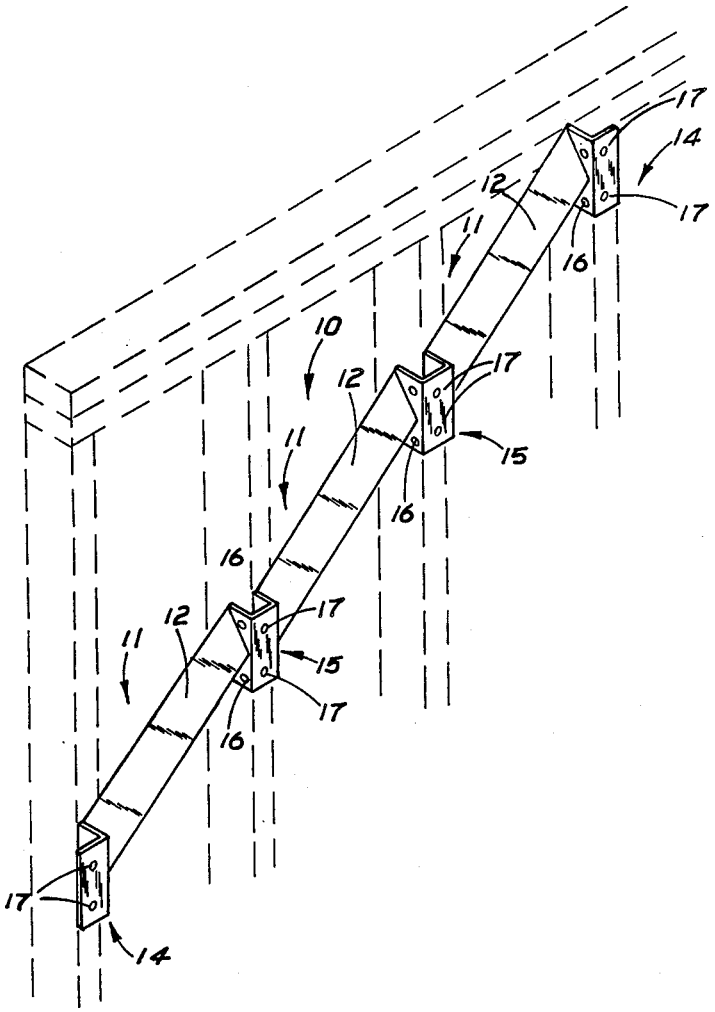
FIG. 6 is an isometric view of the instant invention associated with studded wall (in phantom).

The terminal jaw members 14 are formed in a generally "L" shaped configuration, as illustrated in FIG. 2, with a horizontal leg 14*a* and a single vertical leg 14*b* for association with respective studs, as illustrated in FIGS. 1 and 6.

The intermediate jaw members 15 are formed in a generally "U" shaped configuration, as illustrated in FIG. 2 for example, with downwardly depending vertical leg portions 15*b* secured to a single horizontal portion 15*a* for association with studs intermediate those with respect to the studs attached to the terminal jaw members 14. As illustrated particularly in FIGS. 1 and 6, the interconnection members 11 are integrally and angularly associated to the plurality of jaw members 14 and 15 respectively. This particular angular association enables the positioning of a stud alignment in positioning tool 10 proximate a corner of an associated stud wall, as illustrated in FIGS. 1 and 6, whereby the terminal jaw members 14 are associated to a terminal vertical stud and to a position proximate a horizontal stud to form a triangulated organization with the vertical and horizontal studs, as illustrated in FIGS. 1 and 6, for increased strength and rigidity of the organization enabling the subsequent permanent association of the various studs to the wall to be formed.

The stud alignment and positioning tool 10 may be formed of any suitable rigid material, such as that of metal or of plastic-like configuration whereby the various elements of the organization provide an overall rigid unit and in particular, the interconnection members 11 formed of triangulated construction secured rigidly to the various jaw members.

Additionally, various fastener opening 16 are formed about the various surfaces of the terminal and intermediate jaw members 14 and 15 respectively enabling securement of fastening means, such as nails 17 therethrough, to associated studs. Positioning of fastener openings 16 for enabling the use of various nails and the like 17 therethrough about the vertical and horizontal surfaces of 14*a*, 14*b*, 15*a*, and 15*b* enables a further enhanced rigidity to the organization when utilized, as illustrated in FIGS. 1 and 6.

It is to be understood that more than a plurality of intermediate jaw members 15 may be utilized in the organization dependent upon the number of studs to form a wall. The tool 10 may conveniently be reversed in use to be securable proximate a lowermost corner and once so positioned, a plurality of positioning tools 10 may be secured in a parallel relationship along a stud wall.

As to the manner of usage and operation of the present invention, the same should be apparent from the above description and drawings, and therefore no further discussion relative to the manner of usage and operation will be described.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A stud alignment and positioning device for the securement to and alignment of a plurality of studs comprising, a plurality of terminal rigid jaw means for attachment to said studs at terminal ends of said device, and at least one intermediate rigid jaw means structurally secured to said terminal jaw means intermediate said terminal jaw means;

and interconnection members nonorthogonally and integrally secured to said terminal and intermediate jaw means to structurally secure said jaw means together, and wherein said terminal jaw means are of generally "L" shaped configuration, and wherein said intermediate jaw means are of generally "U" shaped configuration.

2. A stud alignment and positioning device as set forth in claim 1 wherein said terminal jaw means include at least two intermediatge jaw means.

3. A stud alignment and positioning device as set forth in claim 1 wherein openings for the acceptance of fastening means such as nails are formed about all the various surfaces of said intermediate and terminal jaw means for securement of fastening means to said studs at orthogonal angles relative to one another on each respective jaw means.

4. A stud alignment and positioning device as set forth in claim 3 wherein said interconnection member is formed of a first and second connector joined to one another at an apex to define a triangulated member.

* * * * *